US007093325B2

(12) United States Patent
Breuer et al.

(10) Patent No.: US 7,093,325 B2
(45) Date of Patent: Aug. 22, 2006

(54) APPARATUS FOR DETERMINING FIBRE LENGTHS AND FIBRE LENGTH DISTRIBUTION FROM A FIBRE MATERIAL SAMPLE, ESPECIALLY IN SPINNING PREPARATION

(75) Inventors: Achim Breuer, Aachen (DE); Arregui Pedro Corrales, Mönchengladbach (DE)

(73) Assignee: Trützschler GmbH & Co. KG, Monchengladbach (DE)

( * ) Notice: Subject to any disclaimer, the term of this patent is extended or adjusted under 35 U.S.C. 154(b) by 305 days.

(21) Appl. No.: 10/791,846

(22) Filed: Mar. 4, 2004

(65) Prior Publication Data

US 2004/0177479 A1 Sep. 16, 2004

(30) Foreign Application Priority Data

Mar. 14, 2003 (DE) ..... 103 11 345

(51) Int. Cl.
*D01B 3/04* (2006.01)

(52) U.S. Cl. ..... 19/66 CC; 19/65 A

(58) Field of Classification Search ..... 19/65 R, 19/66 CC, 98, 105, 107, 108, 109, 115 R, 19/215, 218, 236, 238, 65 A; 73/159, 160
See application file for complete search history.

(56) References Cited

U.S. PATENT DOCUMENTS 3,057,019 A 10/1962 Hertel
4,827,781 A * 5/1989 Vollm ..... 73/864.41
5,295,401 A * 3/1994 Toedtli ..... 73/863.92
6,598,267 B1 * 7/2003 Shofner et al. ..... 19/66 CC

FOREIGN PATENT DOCUMENTS

| | | |
|---|---|---|
| CH | 488 187 | 5/1970 |
| CH | 627 498 A5 | 1/1982 |
| CH | 637468 A | 7/1983 |
| DE | 44 37 026 A1 | 4/1996 |
| DE | 196 51 893 A1 | 6/1998 |
| DE | 693 29 185 T2 | 8/2000 |
| DE | 693 29 615 T2 | 11/2000 |
| EP | 0 247 420 A1 | 12/1987 |
| GB | 646608 A | 11/1950 |
| GB | 1 244 347 A | 8/1971 |
| GB | 2 320 258 A | 6/1998 |
| SU | 440454 A | 8/1974 |

* cited by examiner

*Primary Examiner*—Gary L. Welch
(74) *Attorney, Agent, or Firm*—Venable LLP; Robert Kinberg

(57) ABSTRACT

In an apparatus for determining fibre lengths and fibre length distribution from a fibre material sample, especially in spinning preparation, collected fibre material is automatically conveyable by a conveyor device, is arranged to be supplied to a take-up device that grips it, is separable from the conveyor device and transportable to at least one rotating combing device, each end region of the collected fibre material protruding from the take-up device being combable by combing device, and subsequently detectable by a measuring device. The apparatus permits within a short time a sample preparation founded on a uniform basis and an accurate measurement of the samples.

29 Claims, 11 Drawing Sheets

APPARATUS FOR DETERMINING FIBRE LENGTHS AND FIBRE LENGTH DISTRIBUTION FROM A FIBRE MATERIAL SAMPLE, ESPECIALLY IN SPINNING PREPARATION

CROSS REFERENCE TO RELATED APPLICATION

This application claims the priority of German Patent Application No. 103 11 345.2, which is incorporated herein by reference.

BACKGROUND OF THE INVENTION

The invention relates to an apparatus for determining fibre lengths and fibre length distribution from a fibre material sample, especially in spinning preparation. In such apparatus, sample preparation elements may be located upstream of the measuring, evaluating and indicating device, said preparation elements comprising a clamping device and a combing element for the treatment of collected fibre material, the combing element producing a fibre fringe that is used for the measurement.

In the practical operation of spinning, fibre slivers taken from production are brought into a fibre laboratory, where the following testing is carried out:

(a) several slivers are placed by hand in clamps previously opened by hand and are carefully, that is, homogeneously, distributed across the width of the clamp and then the clamp is closed by hand.

(b) The fleece is clamped between two leather-covered plates. The plates are pressed into flat abutment with one another. There is no actually defined clamping point.

(c) The fleece is combed by hand using a single-row straight comb.

(d) A round brush is finally used to brush out the fibre fringe again.

(e) One side of the clamp is offered up to a fibrograph, then the clamp is turned over and the other side is offered up to the fibrograph. Using the fibrograph, two fibre fringes are transported past light sources. The source light passing through falls on light receivers and is registered and evaluated.

To test fibre slivers and flyer spinning frame slubbings, the leaflet "Fibrograph 630" of Spinnlab, Knoxville, Tenn., USA describes how, for preparation of a sample, the fibre material sample is opened and spread out and placed in a fibre clamp. The clamp members hold the fibres in their actual arrangement in sample zones. The randomly connected, overlapping, non-parallel relationship between the fibres remains as it is. When the sample has been thus prepared, the fibre clamp is placed in the fibrograph, which brushes out the fibre fringe, scans the sample optically and displays the result of the measurement.

The known sample preparation is time-consuming. Manual handling and processing of the sample and placing thereof in the measuring apparatus are additional to transportation from the spinning works to the test laboratory. It is a further disadvantage that owing to the individual handling of the sample preparation, the samples are not uniformly consistent. Finally, it is inconvenient that a fibre measurement at the location of the spinning machine is not possible.

It is an aim of the invention to produce an apparatus of the kind described in the introduction that avoids or mitigates the said disadvantages, and which in particular makes possible within a short time a sample preparation founded on an equal basis and allows an accurate measurement of the samples.

SUMMARY OF THE INVENTION

The invention provides an apparatus for determining fibre lengths and fibre length distribution from a fibre material sample, comprising a conveyor device for conveying the fibre material, a take-up device for taking up a length of fibre material which can be separated from the conveyor device, and a transport arrangement for conveying the separated length of fibre material to a combing device, at least one end of the length of fibre material being combable by the combing device to form a combed fibre fringe, which combed fibre fringe is subsequently detectable by a measuring device.

Because a conveying device, a clamping device and a combing device, for example at least one combing roller, as well as transfer devices are provided, wherein not only the operation of the afore-mentioned devices as such but also the transfer between the devices is to be effected automatically, the same preconditions for the preparation of all samples are created. In particular, anomalies attributable to manual handling are excluded. It is a further particular advantage that the apparatus can be used in the works directly at the machines or fibre sliver cans. Added to the quicker sample preparation within the apparatus is the considerable time saving gained by carrying out testing away from the fibre laboratory. The fibre lengths and fibre length distribution ascertained can be used for optimum setting of the carding machines (fibre shortening/nep count) and can also be utilised in reducing or removing short fibres from the processed fibre material.

The collected fibre material may be a fibre sliver or the like. The collected fibre material may consist of fibre flocks. Advantageously, the conveyor device comprises at least one roller, a conveyor belt or the like. Advantageously, the conveyor device consists of a roller pair. Advantageously, at least two roller pairs in the form of a tractive drawing system are present. Advantageously, the conveyor device consists of a conveyor roller and a conveyor trough. Advantageously, the conveyor device consists of two continuously revolving conveyor belts. Advantageously, a clamp-type conveyor device is provided. Advantageously, the conveyor device clamps the collected fibre material so that it can be torn off. Within the drawing system the draft is advantageously increased such that a thinned area is created in the collected fibre material (fibre sliver). Advantageously, the conveyor device, especially the drawing system, converts the collected fibre material to a wide and flat structure, for example, a fibre fleece. Advantageously, the number of fibres per length of the fleece length and/or per width of the fleece is variable by way of the draft of the drawing system. Advantageously, the fibres are rendered parallel in the drawing system. Advantageously, fibre hooks are removable in the drawing system. Advantageously, the take-up device is capable of gripping the collected fibre material. Advantageously, the take-up device is capable of holding and/or clamping the collected fibre material. Advantageously, the take-up device comprises a clamping device. Advantageously, the clamping device is capable of clamping the collected fibre material only with its edge regions. Advantageously, the jaws of the clamping device are capable of clamping a fibre sliver sample only with their edge regions. Advantageously, the jaws of the clamping device are capable of clamping a fibre flock sample flat. Advantageously, the clamping device comprises at least one moveable clamping jaw. Advantageously, the collected fibre material can be firmly clamped between the clamping jaws. Advantageously, the clamping device is arranged at the output of the conveyor device, e.g. the delivery roller of the drawing frame. Advantageously, the distance between the output of the conveyor device and the clamping device is the same as or larger than the length of the longest fibre. Advantageously, the clamping device is arranged between the conveyor device and a conveyor element. The conveyor element may be, for example, a suction element, e.g. suction pipe or the like, or a mechanical gripping element, e.g. tongs or the like. Advantageously, the conveyor element is displaceable, e.g. slidable, in the direction of the delivery end of the conveyor device. Advantageously, the clamping device is used as conveyor element.

Advantageously, the clamping device is arranged beneath the conveyor device such that the collected fibre material enters the clamping device by force or gravity. Advantageously, the take-up device and the conveyor device are movable relative to one another. Advantageously, the take-up device is movable in relation to the conveyor device such that the collected fibre material tears away. The take-up device may be movable away from the conveyor device substantially at a right angle, or in an oblique direction. The take-up device may be movable rotationally or pivotally in relation to the conveyor device such that the collected fibre material tears away.

Both ends of the separated length of fibre material may be combed. Advantageously, the combing device, e.g. at least one rotating combing roller, and the clamped collected fibre material are movable relative to one another. Advantageously, the combing roller is equipped with a clothing, needles, saw-teeth or similar. Advantageously, the speed and/or direction of rotation is alterable, especially controllable. Advantageously, the relative movement between clamping device and combing roller is alterable, especially controllable. Advantageously, the combing roller rotates at a low speed, for example, 10 to 50 rpm. Advantageously, the combing roller comprises a perforated roller base body. Advantageously, a high-speed cleaning roller is associated with the combing roller. Advantageously, an extraction device is associated with the combing roller and/or cleaning roller. Advantageously, the end regions of the collected fibre material (fibre fringe) are alignable in a defined manner, preferably substantially straight. Advantageously, a suction element, e.g. suction pipe or the like, or a mechanical element, e.g. tongs, gripper, or the like, is provided as aligning element. Advantageously, the aligning element and the clamping element are movable relative to one another.

Advantageously, a fibrograph device is provided as a measuring device. Advantageously, the fibrograph comprises at least one light source and at least one light receiver. Advantageously, the fibrograph device and the clamping device are movable relative to one another. Advantageously, in the measuring device, e.g. fibrograph, measuring is carried out by traversing forwards and backwards across the collected fibre material (fibre fringe).

The apparatus is advantageously portable. Advantageously, the apparatus has a supply interface and a data interface to at least one spinning machine. Advantageously, an electronic microcomputer control device, with microprocessor, is provided, to which at least one of the elements drive motor of the conveyor device, actuator for the clamping movement of the clamping device, actuator for moving the clamping device, actuator for moving the at least one aligning device, combing roller drive motor and actuator for moving the measuring device are connected.

Advantageously, the fibre material sample to be measured is prepared automatically by the sample-preparation device. Advantageously, the sample preparation and the measuring are effected automatically. Advantageously, as collected fibre material a fibre sliver can be drawn from a spinning can, which may be connected downstream of a card or downstream of a draw frame. Advantageously, the spinning can is connected downstream of a drawing system, e.g. card drawing system, drawing system of a draw frame, drawing system of a combing machine, drawing system of a flyer spinning frame.

Advantageously, the collected fibre material is arranged to be conveyed continuously by the conveyor device. Advantageously, the torn-away collected fibre material is about 200 mm long. The collected fibre material may be removed from a spinning machine, e.g. a card. For example, the collected fibre material may be removed from the feed region or the incoming fibre flock feed of the card. The collected fibre material may be removed before treatment with clothing elements, e.g. clothed or needled rollers, fixed carding elements or the like. The collected fibre material may be removed from the delivery region of the card. The collected fibre material may be removed after treatment with clothing elements, e.g. clothed or needled rollers, fixed carding elements or the like. The collected fibre material may be removed from a roller of a card, for example, from a licker-in or doffer of the card. Advantageously, the determined measured values of the fibre lengths (staple) and fibre length distribution from the feed region of the card, e.g. fibre flock feed, and from the delivery region of the card, e.g. card sliver in the spinning can, are compared with one another. Advantageously, the determined measured values of the fibre length distribution from the sliver in aggressive and in gentle processing are compared with one another. Advantageously, the determined measured values of the fibre length distribution from the sliver in aggressive and gentle settings of individual assemblies are compared with one another. Advantageously, fibre shortening and/or fibre damage due to processing on the card are ascertained from the comparison of the measured values. From the fibre lengths and the fibre length distribution a characteristic number is advantageously determined, which describes the fibre stress during processing. From the fibre lengths and the fibre length distribution a characteristic number is advantageously determined, which describes the extent of hooks in the sliver. The fibre sliver may be tested several times at one section, and then the same sliver automatically be drawn off further in order to be tested several times at a different point. The collected fibre fringe may be removed from the open clamp by suction, by means of brushes, or by means of combing rollers. Advantageously, a device for moving the clamping elements of the clamping device is present. Advantageously, a device for moving the take-up device is present. Advantageously, a device for moving the clamping device is present. Advantageously, a device for moving each combing roller is present. Advantageously, a device for moving the measuring device is present. Advantageously, at least one measuring device is connected to the electronic machine control and regulating system, e.g. the card. Advantageously, the measured values are used to set the spinning machine, e.g. the card. Advantageously, actuators for setting the machine elements and operating elements of the machine, e.g. the card, are connected to the electronic machine control and regulating system.

Advantageously, the determined measured values of the fibre lengths (staple) and the fibre length distribution from the feed region of the card, e.g. fibre flock supply, and from the delivery region of the card, e.g. the card sliver in the spinning can, are compared with one another. The measured values of the fibre length distribution determined from the sliver in aggressive and gentle processing are preferably compared with one another. The measured values of the fibre length distribution determined from the sliver in aggressive and gentle settings of individual assemblies, e.g. clothed revolving card top or fixed card top, are preferably compared with one another. Advantageously, fibre shortening and/or fibre damage due to processing on the card are ascertained from the comparison of the measured values. A fibre damage sensor (fibre stress sensor FSS) is created by the above-mentioned measures. It is possible to obtain accurate information about staple shortening caused by the card. By adjusting operating elements or machine elements, it is therefore possible to achieve the least possible damage to the fibre at the card.

The invention also provides an apparatus for determining fibre lengths and fibre length distribution from a fibre material sample, especially in spinning preparation, in which sample preparation elements are located upstream of the measuring, evaluating and indicating device, said preparation elements comprising a clamping device and a combing element for the treatment of collected fibre material, the combing element producing a fibre fringe that is used for measurement, characterised in that the collected fibre material is automatically conveyable by a conveyor device, is arranged to be supplied to a clamp-type take-up device, is separable from the conveyor device and transportable to at least one rotating combing device, each end region of the collected fibre material protruding from the take-up device being combable by the combing device and subsequently detectable by the measuring device.

BRIEF DESCRIPTION OF THE DRAWINGS

FIGS. 5*a* to 5*k* shows schematically the mode of operation of the apparatus according to the invention;

DESCRIPTION OF THE PREFERRED EMBODIMENTS

Figure 1:
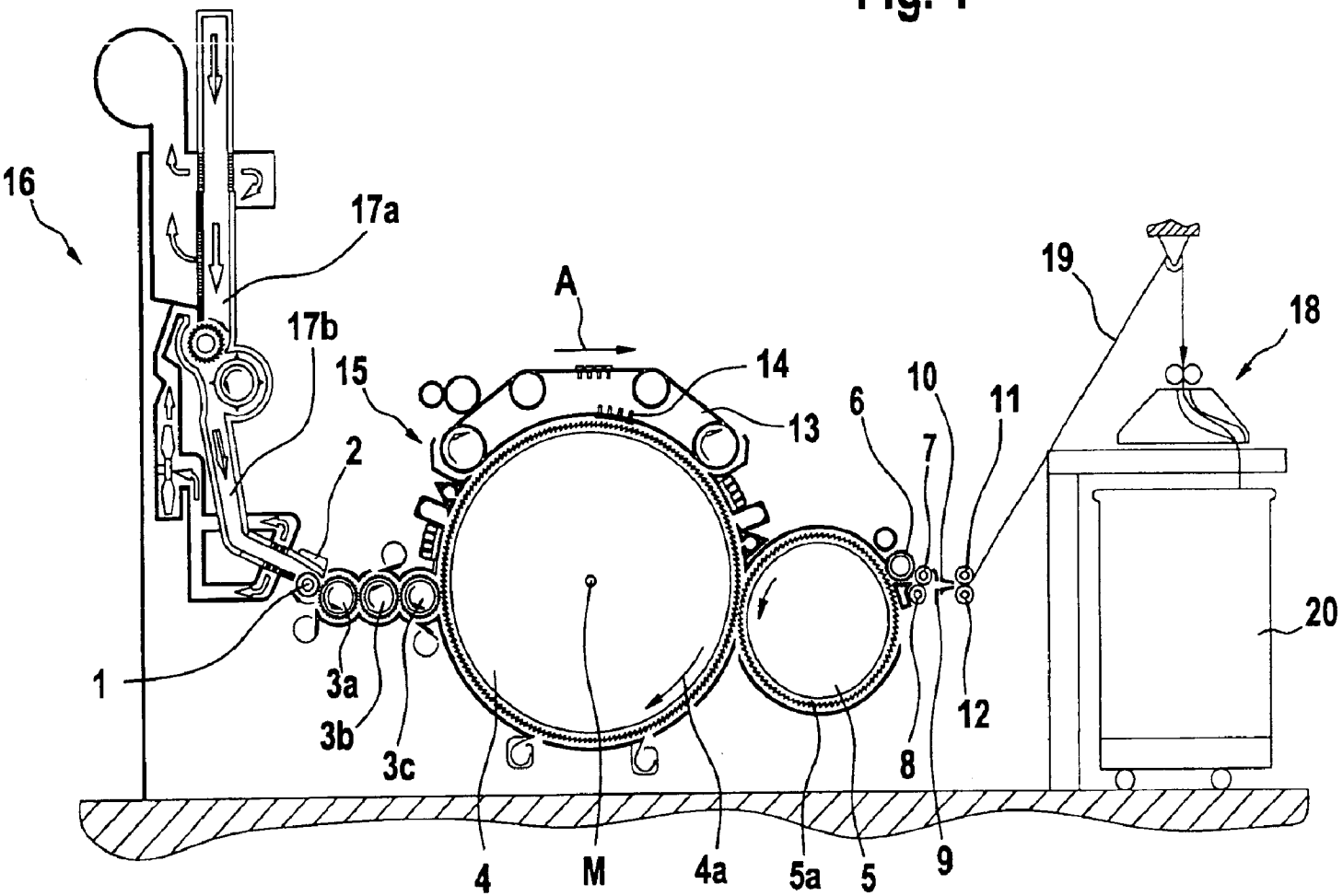
FIG. 1 is a schematic side view of a card on which the apparatus according to the invention can be used.

FIG. 1 shows a carding machine 15, for example, a high performance card DK 903 made by Trützschler GmbH & Co. KG of Mönchengladbach, Germany, with feed roller 1, feed table 2, licker-ins 3*a*, 3*b*, 3*c*, cylinder 4, doffer 5, stripping roller 6, squeezing rollers 7, 8, web-guide element 9, web funnel 10, take-off rollers 11, 12 and revolving card top 13 with carding segments 14. The directions of rotation of the rollers are shown by respective curved arrows. The letter A denotes the working direction. A chute feed 16 for the flocks, for example, a Direktfeed DFK made by Trützschler GmbH & Co. KG, is located upstream of the card 15. The chute feed 16 comprises an upper reserve hopper 17*a* and a lower feed chute 17*b*. The pneumatically compacted (not illustrated) fibre flock material is removed at the end of the feed chute 17*b* by the feed roller 1 and directed through the gap between feed roller 1 and feed table 2 to the high-speed licker-in 3*a*. A can coiler 18 is located at the delivery end of the card 15; the fibre sliver 19 discharged from the card 15 is laid by the can coiler in coils in a spinning can 20.

Figure 2:
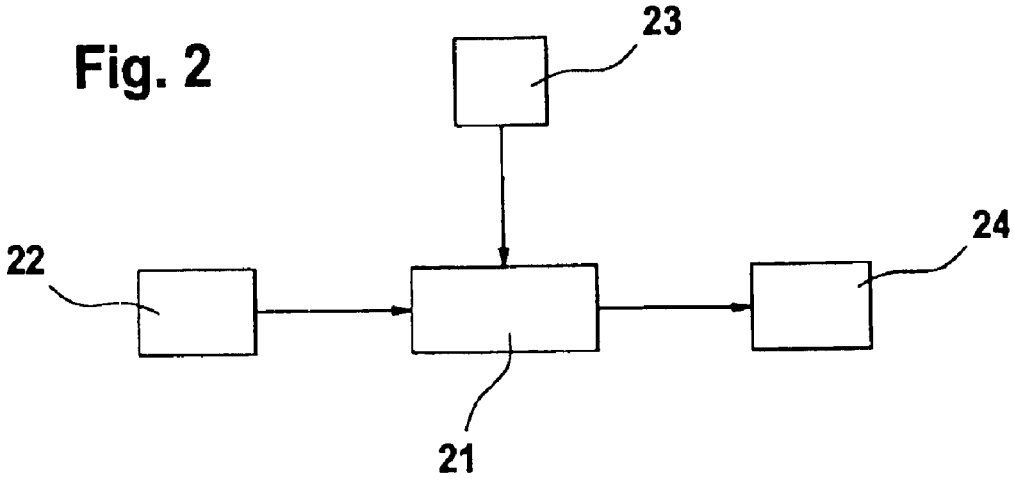
FIG. 2 is a block circuit diagram of an electronic card-control and regulating system, to which at least the apparatus according to the invention and an actuator, e.g. motor, are connected.

Referring to FIG. 2, the apparatus according to the invention with measuring element 23 for the fibre lengths, a measuring element 22 for the nep count, e.g. a Nepcontroll NCT made by Trützschler GmbH & Co. KG, and an actuator 24 for the card 15 are connected to an electronic control and regulating system 21, for example a machine control system with microprocessor. The measuring element 23 can be used to measure in succession the fibre material at the feed region 15, for example, the fibre flock feed, and at the delivery end of the card 15, for example, to measure the card sliver 19. From the measured values of the fibre lengths at the feed and delivery ends of the card 15, fibre damage is assessed in the control 21. From the fibre damage and the nep count measured, the control determines an optimum setting value for operating elements of the card 15, which is adjusted by way of the actuator 24, for example, a controllable drive motor, stepping motor or similar.

Figure 3:
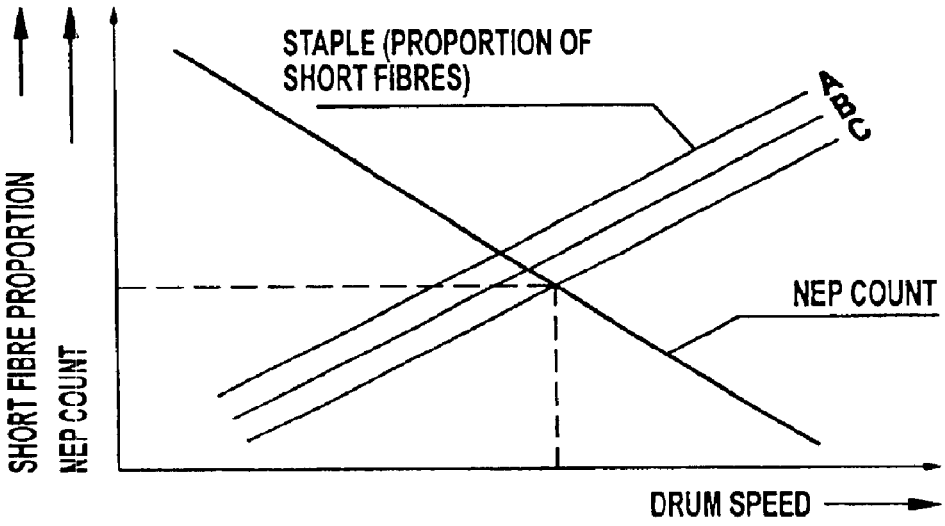
FIG. 3 shows the dependency of the short fibre proportion and the nep count on the speed of the cylinder for different fibre qualities.

Referring to FIG. 3, as the speed of the cylinder 4 increases, the nep count decreases and fibre shortening increases. The dependency of fibre shortening is illustrated for the fibre qualities A, B and C. The intersection point between the curves for the nep count and for fibre shortening constitutes the optimum value (see broken line). This optimum value is calculated and determined in the control and regulating system 21 from the entered curves for nep count and for fibre shortening. This involves a comparison with characteristic curves contained in the desired value memory.

Figure 4:
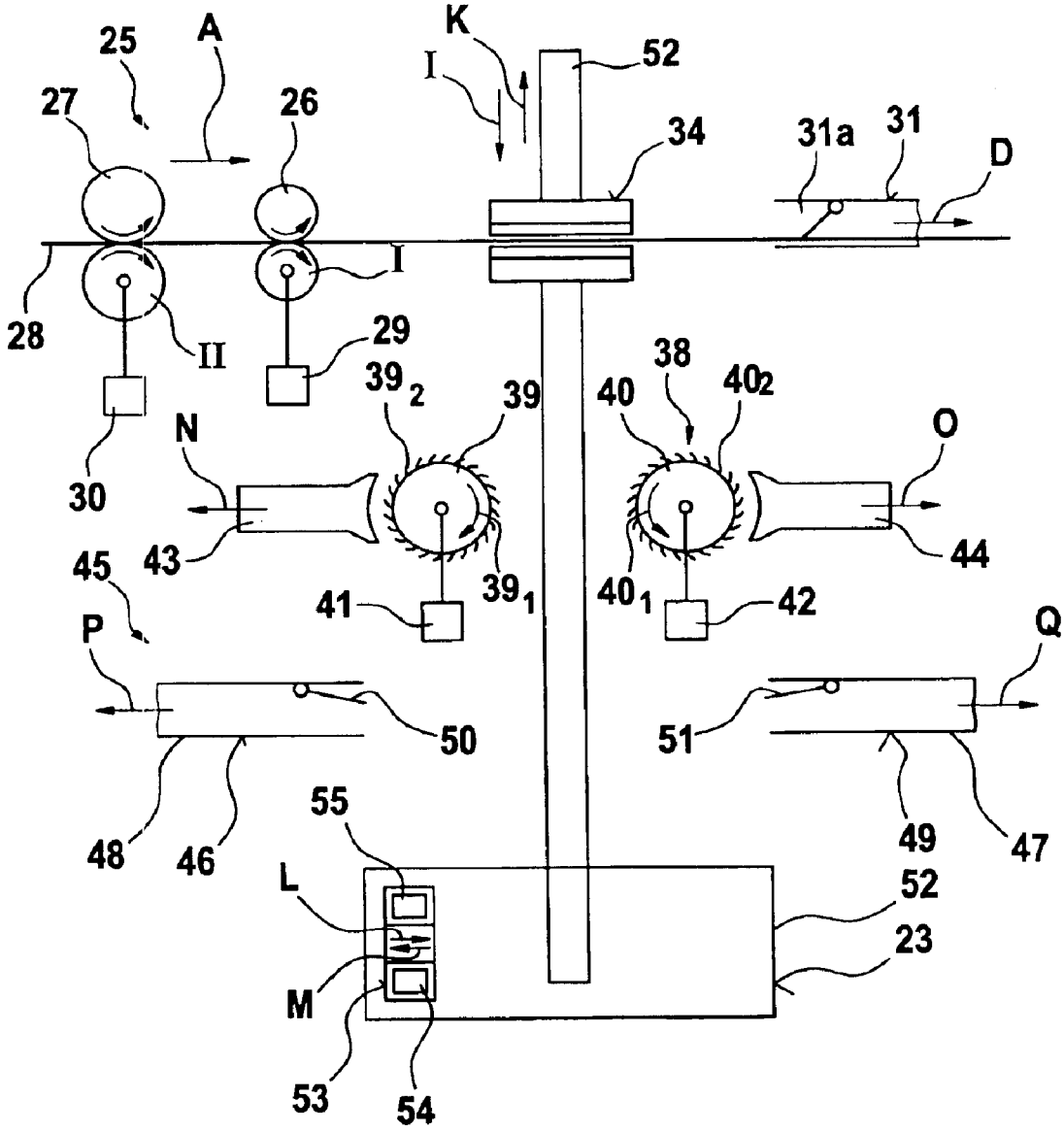
FIG. 4 is a side view of the apparatus according to the invention.
Figure 4A:
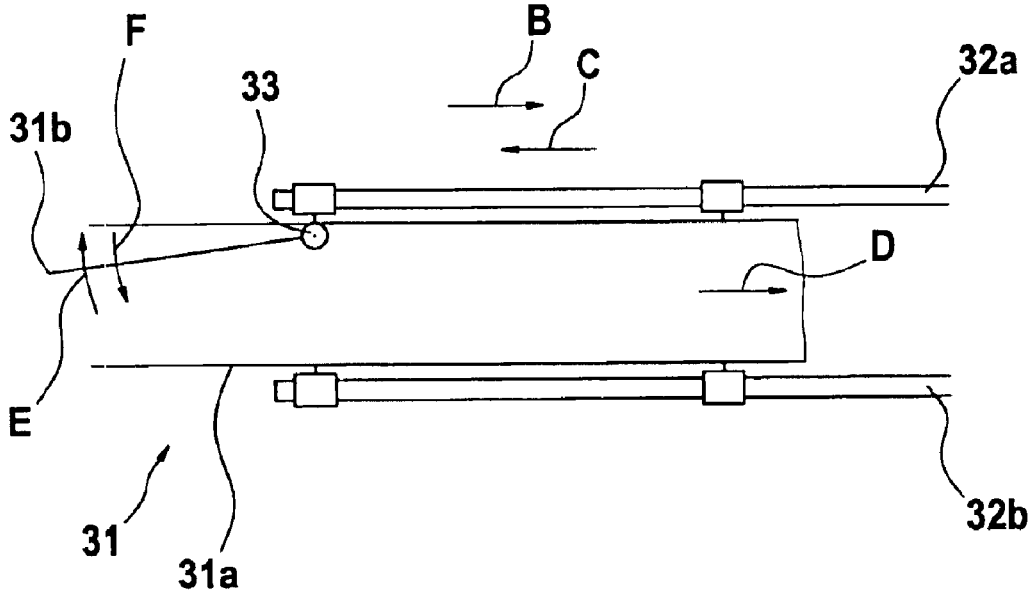
FIG. 4*a* shows a suction pipe as conveyor element with a gripper flap as shown in FIG. 4 for the fibre material leaving the drawing system.
Figure 4B:
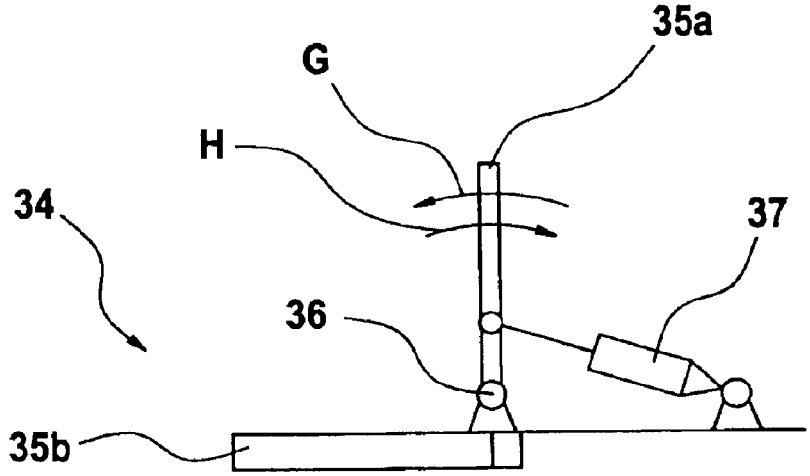
FIG. 4*b* is a side view of the take-up device shown in FIG. 4.
Figure 4C:
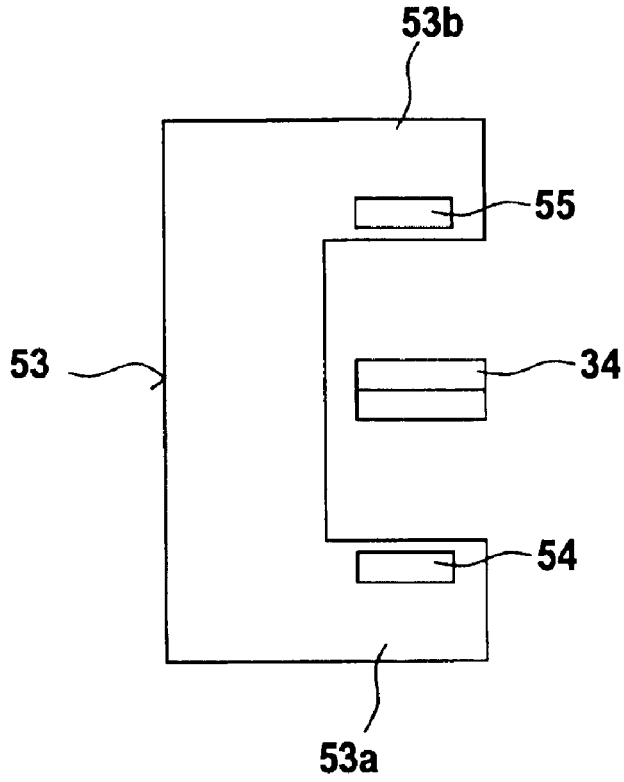
FIG. 4*c* is a side view of the detector device shown in FIG. 4.

According to FIG. 4, the device for determining fibre length and fibre length distribution from a fibre material sample, e.g. the fibre sliver 28, fibre flocks or similar, comprises a measuring, evaluating and indicating device in the form, for example, of a fibrograph 23. Sample preparation elements are arranged upstream of the fibrograph 23. For that purpose a drawing system 25 is provided as conveying device, for example, a 2-over-2 drawing system known per se, that is, it consists of two bottom rollers I, II, (I being the bottom delivery roller, II being the bottom feed roller) and two top rollers 26, 27. Drafting of the fibre material 28, for example, a fibre sliver 19 from a card 15, takes place in the drawing system 25. The roller pairs 26/I and 27/II are driven by variable speed drive motors 29 and 30 respectively. The directions of rotation of the rollers I, II, 26 and 27 are indicated by curved arrows. The letter A denotes the working direction (direction of travel of the fibre sliver 28). Substantially in alignment with the nip lines between the roller pairs 26/I and 27/II, a conveyor element 31 is provided at a distance from the roller pair 26/I for transporting the fibre sliver 28 emerging from the delivery rollers 26/I. As shown in FIG. 4*a*, the conveyor element 31 is mounted on two guide elements 32*a*, 32*b*, for example, bars, guideways, rails or the like, and is displaceable in the direction of arrows B, C. The conveyor element 31 comprises a suction pipe 31*a*, which is connected to a source of suction (not shown) that draws air in direction D through the suction pipe 31*a*. In an end region of the suction pipe 31*a* a gripping flap element 31*b* or similar is provided, which at one end is mounted at a pivot bearing 33 so as to rotate in the direction of arrows E, F. The flap element 31*b* can be driven by a drive element (not shown), for example, a pneumatic cylinder or similar. In its closed position (direction of rotation F), the flap 31*b* clamps the fibre sliver 28 firmly against the inner wall of the suction pipe 31*a*. Also substantially in alignment with and spaced from the delivery roller pair 26/I is a clamp-type take-up device 34, which clamps the transported fibre sliver 28 firmly and hence holds or fixes it. As shown in FIG. 4*b*, the take-up device 34 comprises two clamping elements 35*a*, 35*b*, for example, clamping jaws or similar. The clamping jaw 35*a* is mounted at a pivot bearing 36 so as to rotate in the direction of arrows G, H, and one end of a pneumatic cylinder 37 is articulated on the clamping jaw 35*a*. The clamping jaws 35*a*, 35*b* together form a module, which can be moved to the desired location (see FIG. 5*e*, arrow I). Substantially perpendicularly beneath the take-up device 34 there is a combing device 38, which comprises two combing rollers 39, 40 with their axes parallel to one another, which are driven by two variable speed drive motors 41, 42 respectively. The combing rollers 39 and 40 turn slowly, for example, at 20 rpm in the direction of arrows $\mathbf{39}_1$ and $\mathbf{40}_1$. The direction of rotation of the combing rollers 39, 40 is reversible, in order to comb out the fibre fringes 28*a*, 28*b* from two sides. The combing rollers 39, 40 are equipped on their circumferential surfaces with a respective combing clothing $\mathbf{39}_2$ and $\mathbf{40}_2$. At their outer side, each combing roller 39 and 40 is associated with a suction device 43, 44 respectively connected to sources of suction air (not illustrated) for extracting in directions N and O respectively the fibre material surplus to the fibre fringes 28*a*, 28*b*, especially the fibre material combed out of the fibre fringes 28*a*, 28*b*. Beneath the combing device 38 there is a fibre-aligning unit 45, which comprises two conveyor elements 46 and 47, which can essentially be of a construction identical to that of the conveyor element 31 (cf. FIG. 4*a*). The conveyor elements 46 and 47 also have in this case a respective suction pipe 48, 49, which are arranged coaxially with respect to one another. The inlet openings of the suction pipes 48, 49, with which the pivoting gripper flaps 50, 51 respectively are associated, face towards one another. The direction of the suction air currents is denoted by letters P and Q. The conveyor elements 46, 47 serve to align the fibre fringes 28*a*, 28*b*, which are angled or bent upwards or downwards by the direction of rotation $\mathbf{39}_1$, $\mathbf{40}_1$ of the combing rollers 39, 40. As measuring device, a fibrograph 23 is arranged beneath the fibre-aligning unit 45. The fibrograph 23 consists of a housing 52 in which there is provided a sensor element 53 movable, for example, slidable, in the direction of arrows L, M. As shown in FIG. 4*c*, the sensor element 53 is U-shaped in cross-section, a light emitter 54, for example a lamp or similar, being arranged in the limb 53*a* and a light receiver 55, for example, a photocell or similar, being arranged in the limb 53*b*. The sensor 53 is movable in the direction of the arrows L, M (see FIG. 4) such that the take-up device 43 with the fibre fringes 28*a*, 28*b* that is stationary between the light transmitter 54 and the light receiver 55 can be detected by the light transmitter 54 and the light receiver 55. To convey the fibre material 28 from the level of the drawing system 25 and the conveyor element 31 substantially perpendicularly from top to bottom by means of the take-up device 34 via the combing device 38 and the fibre-aligning device 45 to the fibrograph 23, a vertical guide element 52, for example, a rod, guideway, rail or the like is provided. The take-up device 34 is movable, for example, slidable, on the guide element 52 in the direction of the arrows I, K. Retainers (not shown), for example, locking devices, are provided here at the level of the elements 38, 45 and 23.

Figure 5A:
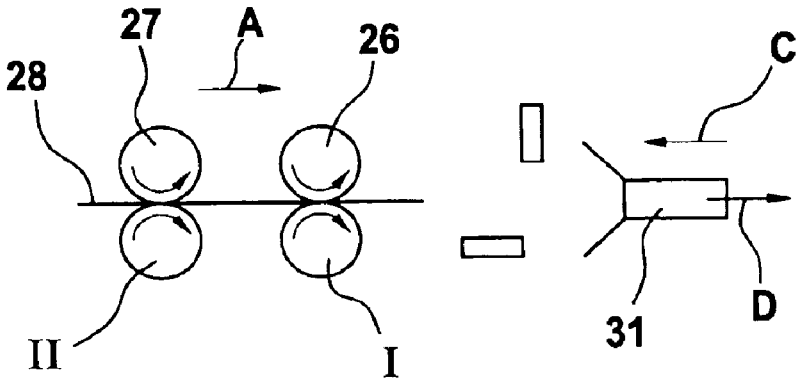
Figure 5B:
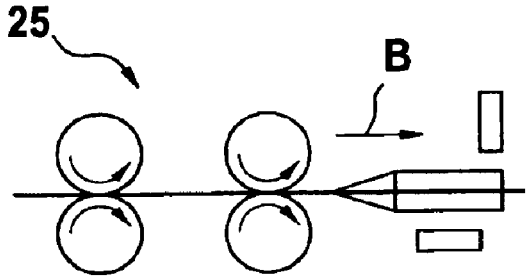
Figure 5C:
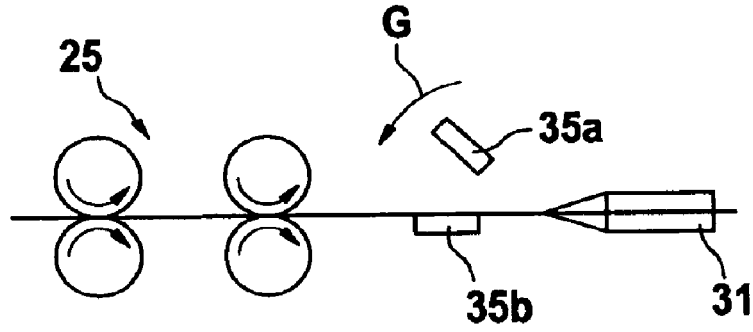
Figure 5D:
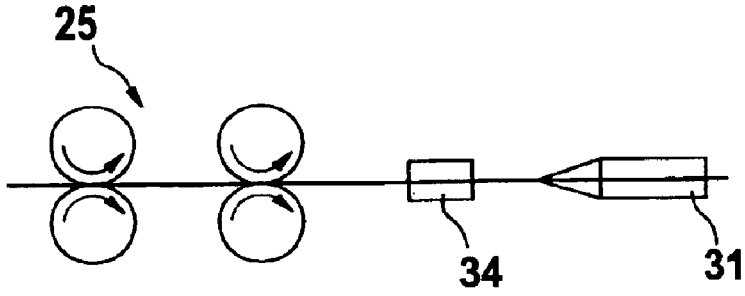
Figure 5E:
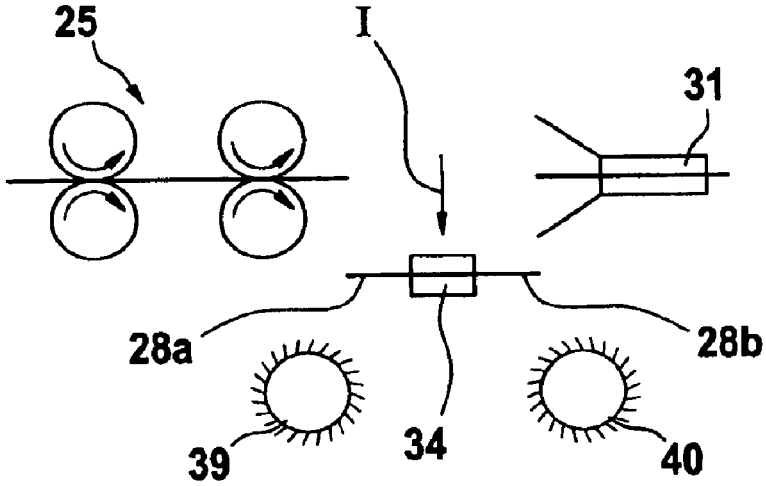
Figure 5F:
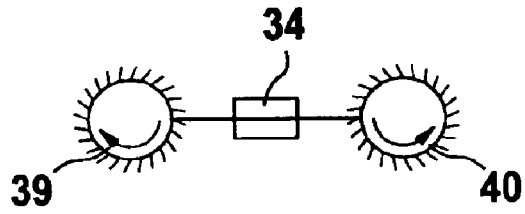
Figure 5G:
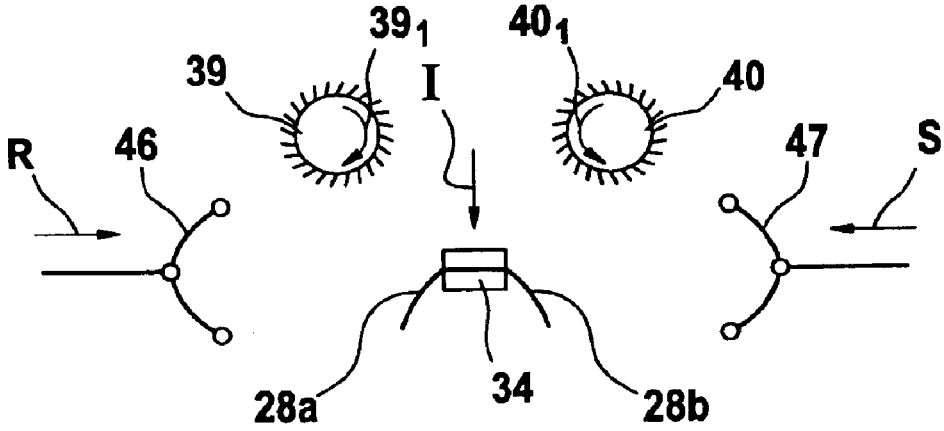
Figure 5H:
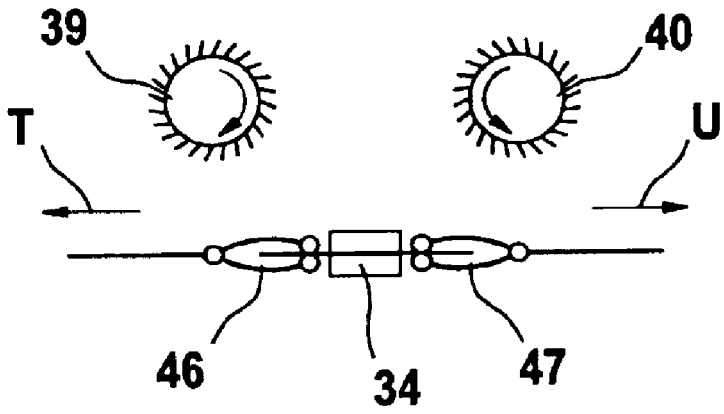
Figure 5I:
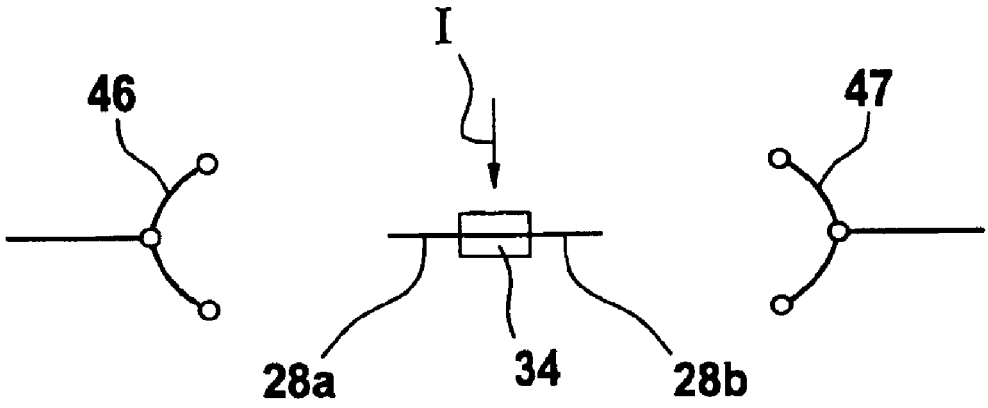
Figure 5K:
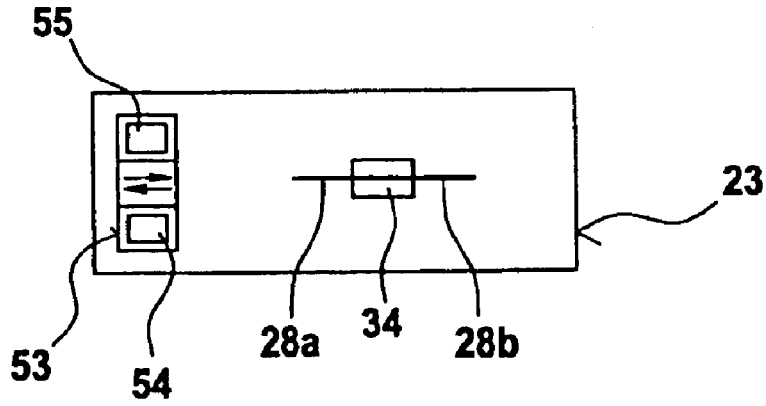

Referring to FIG. 5*a*, a fibre sliver 28 of round or oval cross-section is transported right through the drawing system 25 and converted by the draft and the pressure of the roller pairs 26/I and 27/II to a flat, fleece-form structure. The fibre material 28 is at the same time spread out laterally (parallel to the roller axes of the drawing system 25). The conveyor device 31 is moved in direction C towards the roller pair 26/I until it is a short distance therefrom, the short end of the fibre material 28 protruding from the roller nip of the delivery rollers 26/I being taken up and sucked by the current of suction air D into the inner space of the suction pipe 31*a* (FIG. 4*a*). The conveyor element 31 is subsequently moved in direction B, as shown in FIG. 5*b*, the delivery speed of the drawing system 25 and the speed of movement of the conveyor element 31 being co-ordinated with one another or synchronised with one another such that the structure of the fibre sliver 28 is not impaired, in particular the fibre material 28 is not torn. As FIGS. 5*b* and 5*c* show, the fibre material 28 is pulled right through the take-up device 34. The clamping jaws 35*a*, 35*b* (FIG. 4*b*) are subsequently moved towards one another or closed, so that the fibre sliver 28 is firmly clamped or fixed between the clamping jaws 35*a*, 35*b*, as shown in FIG. 5*d*. In a next step, the take-up device 34, together with the gripped fibre sliver 28 is displaced downwards along the guide 52 (FIG. 4) in direction I. As this happens, the gripped fibre material 28 tears away from the fibre material 28 clamped in the drawing system 25 and the fibre material 28 gripped in the conveyor element 31, a short fibre fringe 28*a*, 28*b* protruding from the take-up device 34 from a respective one of the two sides thereof. The take-up device 34 is moved between the two combing rollers 39, 40, as shown in FIG. 5*e*, whereupon the fibre fringes 28*a*, 28*b* come into the operating range of the rotating clothings $\mathbf{39}_2$, $\mathbf{40}_2$. The fibre fringes 28*a*, 28*b* are thus combed out, the fibre material removed by combing in the clothings $\mathbf{39}_2$, $\mathbf{40}_2$ being extracted by suction through the suction pipes 43 and 44 respectively. The process illustrated in FIGS. 5*e* and 5*f* can be repeated several times, by displacing the take-up device 34 in the direction of arrows I and K (see FIG. 4) into and out of the space between the combing rollers 39, 40, the directions of rotation 39, 40 being reversed each time. In this way, the fibre fringes 28*a*, 28*b* are combed several times from two sides each. If rotation is effected in the directions 391, 40, illustrated in FIG. 5*g*, the fibre fringes 28*a*, 28*b* are bent correspondingly downwards. To align the fibre fringes 28*a*, 28*b* in a straight line, the conveyor elements 46, 47 shown in FIG. 5*g* are moved in the direction of arrows R and S respectively such that the fibre fringes 28*a*, 28*b* are taken up and clamped as shown in FIG. 5*h*. The conveyor elements 46 and 47 shown in FIG. 5*h* are subsequently moved slowly in the direction of arrows T and U respectively, with the result that the fibre fringes 28*a*, 28*b* are aligned straight and substantially horizontally or parallel to the axis of the take-up device 34. As shown in FIGS. 5*i* and 5*k*, the take-up device 34 with the aligned fibre fringes 28*a*, 28*b* is moved along the guide 52 (FIG. 4) into the fibrograph 23. The take-up device 34 reaches the level of the intermediate space between the light transmitter 54 and the light receiver 55 (see FIG. 4*c*) within the sensor 53. The sensor 53 is subsequently displaced back and forth in the direction of arrows L, M (FIG. 4) over the take-up device 34. As this happens, the light transmitter irradiates the fibre fringes 28*a*, 28*b*; the light rays passing through are received by the light receiver 55, converted into electrical signals and fed (in known manner) to an evaluating and display device.

Figure 6:
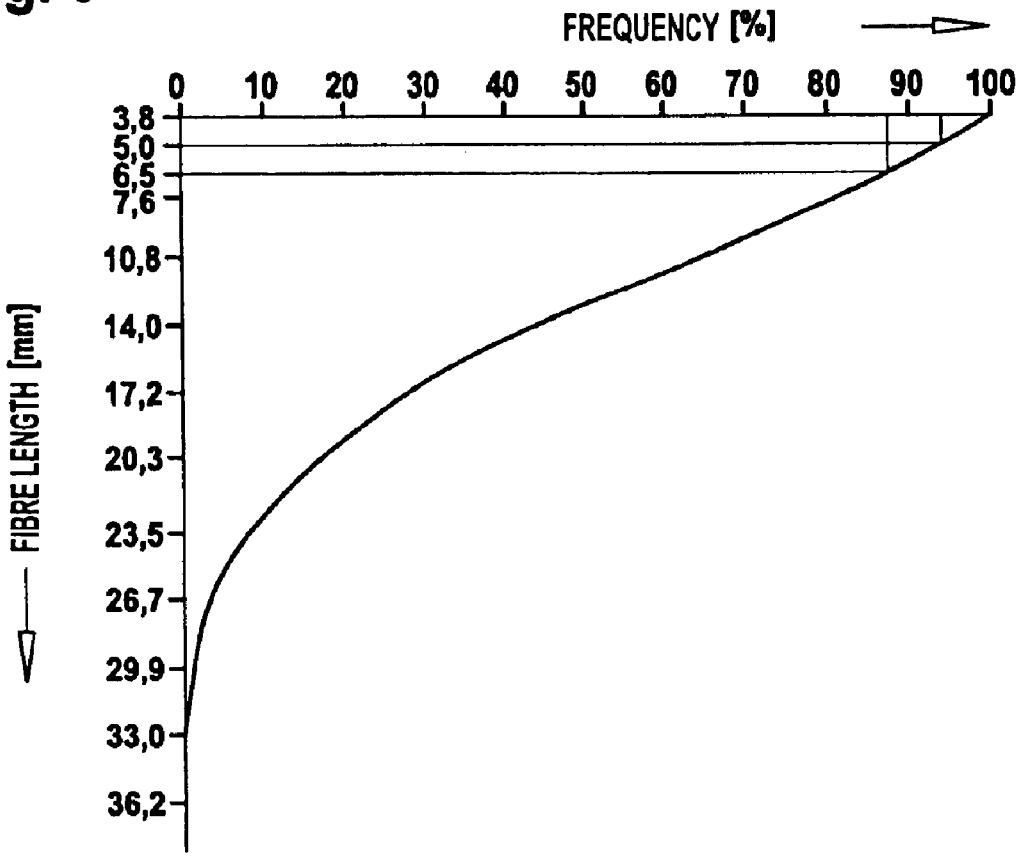
FIG. 6 shows a spectogram.

In this way, the fibre lengths and fibre length distribution in the fibre fringes 28*a*, 28*b* are ascertained by means of the fibrograph 23, which reproduces the analysis in the form of a fibrogram (fibre fringe curve, length distribution of the fibres). Such a graph is shown in FIG. 6. Frequency in percent is plotted on the horizontal axis and the fibre length in millimetres is plotted on the vertical axis. The fibrogram shown in FIG. 6 as an example shows that 100% of all fibres have a length of at least 3.8 mm. About 93% of all fibres have length of more than 5 mm and about 88% of all fibres have a length of more than 6.5 mm. As the graph shows, the longer is the fibre length, so the proportion of fibres of the total amount of fibre becomes less, until ultimately at fibre lengths of more than about 34 mm no more fibres are to be found. It has been shown that fibres of less than 6 to 6.5 mm length are unable to contribute to the strength of the spun yarn. For that reason, from the curve shown in FIG. 6 it is possible to determine what percentage of all fibres has a length that is less than the set minimum length of 5 to 6.5 mm. The fibrogram shows for 5 mm, for example, that 7% of all fibres are shorter than 5 mm. This same curve shows that 12% of all fibres are shorter than 6.5 mm. This 7 to 12% thus established is used preferably for setting the carding intensity of the card. The data for the staple diagram can be entered in the electronic control and regulating system 21 shown in FIG. 2. From this data and from the data for the nep count, an optimum value serving for setting the carding intensity of the card 15 is calculated.

Figure 7:
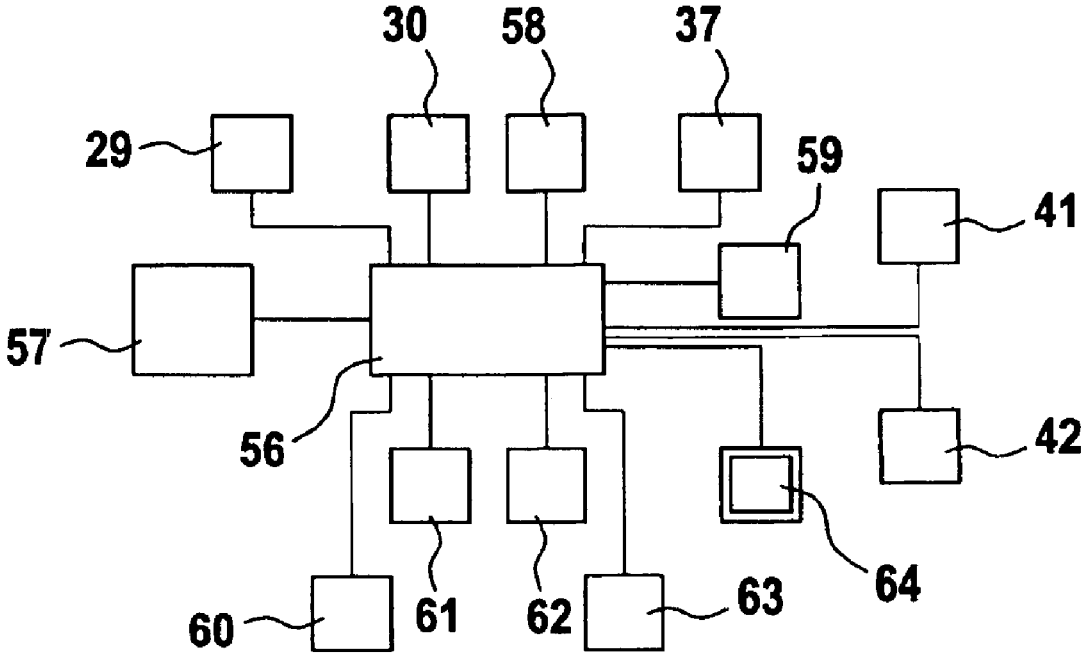
FIG. 7 is a block circuit diagram of an electronic control and regulating system of the apparatus according to the invention.

Referring to FIG. 7, an electronic control and regulating system 56 for the apparatus according to the invention comprises a microcomputer with microprocessor, to which are connected the drive motors 29, 30 for the drawing system 25, a drive motor 57 for moving the conveyor element 31, a drive device 58 for control of the flap 31*b*, an actuator 37 for the clamping device 35*a*, 35*b*, an actuator 59 for moving the take-up device 34, the drive motors 41, 42 of the combing rollers 39, 40, actuators 60, 61 for moving the conveyor elements 47, 48, a drive motor 62 for moving the sensor 53, and a display means, for example, a screen 64, printer or the like. The machine control and regulating system 21 (FIG. 2) can also be used, via an interface, as control and regulating system for the fibrograph 23. Using the apparatus according to the invention, both the work of the sample-preparation elements and of the fibrograph 23 and the displacement of the fibre material 28 and the fibre fringes 28*a*, 28*b* between the sample preparation elements and the fibrograph 23 are controlled and hence automatically realised.

The following advantages inter alia are obtained with the device according to the invention, hereinafter abbreviated to FSS:

- the FSS measurement is carried out more quickly than all known measurements.
- The FSS sample preparation and measurement is effected fully automatically.
- The entire FSS sample testing ensures a consistent sample preparation and measurement.
- The FSS sample preparation is carried out carefully and uniformly.
- Fibre lengths of clearly below 3.8 mm are reliably detected with the FSS test apparatus.
- More fibres than in the HVI measurement procedure are tested with the FSS testing method.
- All types of fibre can be measured with the FSS apparatus.
- The fibre material can be removed directly from the spinning can with the FSS apparatus.
- A random size sample per test can be measured automatically with the FSS apparatus.
- If required, fibre tests can be carried out with the FSS apparatus automatically at constant sliver length intervals transversely through an entire spinning can.
- Measurements can be carried out directly at the spinning machine with the FSS apparatus.
- The FSS apparatus can be connected via an interface directly to a spinning machine.
- The forwards and backwards measurement enables characteristic values to be calculated and allows information to be obtained about fibre hooks.
- The sliver structure can be quantified using the FSS apparatus.
- The FSS apparatus is portable.

Although the foregoing invention has been described in detail by way of illustration and example for purposes of understanding, it will be obvious that changes and modifications may be practised within the scope of the appended claims.

What is claimed is:

1. An apparatus for determining fibre lengths and fibre length distribution from a fibre material sample, comprising a conveyor device for conveying the fibre material, a take-up device for taking up a length of fibre material which can be separated from the conveyor device, and a transport arrangement for conveying the separated length of fibre material to a combing device, at least one end of the length of fibre material being combable by the combing device to form a combed fibre fringe, which combed fibre fringe is subsequently detectable by a measuring device.

2. An apparatus according to claim 1, in which the conveyor device comprises at least one element selected from conveyor belts and rollers.

3. An apparatus according to claim 1, in which the conveyor device comprises a drawing device.

4. An apparatus according to claim 3, in which the draft of the drawing device is adjustable for varying the number of fibres per unit length of the fibre material and/or per unit width of the fibre material.

5. An apparatus according to claim 1, further comprising a clamping element downstream of the take-up device.

6. An apparatus according to claim 5, in which the clamping element is slidably displaceable with respect to the take-up device.

7. An apparatus according to claim 1, in which the conveyor device clamps the fibre material such that it can be torn off.

8. An apparatus according to claim 1, in which the take-up device comprises a clamping device.

9. An apparatus according to claim 8, in which the clamping device comprises at least one movable clamping jaw.

10. An apparatus according to claim 1, in which the take-up device and the conveyor device are movable relative to one another.

11. An apparatus according to claim 10, in which the take-up device is movable in relation to the conveyor device such that, in use, the fibre material tears away from the conveyor device.

12. An apparatus according to claim 1, in which the combing device comprises at least one rotating combing roller.

13. An apparatus according to claim 12, in which the speed of the combing roller is adjustable.

14. An apparatus according to claim 12, in which the direction of rotation of the combing roller is adjustable.

15. An apparatus according to claim 1, in which relative movement between the take-up device and the combing device is adjustable.

16. An apparatus according to claim 1, in which there is a cleaning device for cleaning the combing device.

17. An apparatus according to claim 1, further comprising an aligning device for aligning fibres within said combed end or ends.

18. An apparatus according to claim 1, further comprising a measuring device for determining fibre lengths and/or fibre length distribution in said combed end or ends.

19. An apparatus according to claim 18 in which the measuring device is arranged to reciprocate across the fibre material for effecting said determination.

20. An apparatus according to claim 1, further comprising an electronic control device, to which there is connected at least one element selected from a drive motor for the conveyor device, an actuator for a clamping movement of the take-up device, an actuator for moving at least one aligning device, a drive motor for the combing device and an actuator for moving a measuring device.

21. An apparatus according to claim 1, which is arranged to collect fibre material before treatment thereof with clothed elements.

22. An apparatus according to claim 21, which is arranged to collect fibre flocks (tufts).

23. An apparatus according to claim 1, which is arranged to collect fibre material after treatment thereof with clothed elements.

24. An apparatus according to claim 23, which is arranged to collect fibre sliver.

25. An apparatus according to claim 1, comprising a control device in which determined values for a fibre length and fibre length distribution from a feed region of a spinning preparation machine can be compared with determined values for a delivery region of the machine.

26. An apparatus according to claim 1, comprising a control device in which determined values of fibre length distribution for sliver subjected to aggressive processing and sliver subjected to gentle processing can be compared.

27. An apparatus according to claim 1, which is connected to a control system of a spinning preparation machine, the arrangement being such that the settings of the spinning preparation machine are adjustable in dependence on the determined measurements of fibre length and fibre length distribution.

28. An apparatus according to claim 27, which is arranged to determine from the measured fibre lengths and/or fibre length distributions a characteristic number relating to fibre stress during processing and/or a characteristic number relating to the extent of fibre hooks in the sliver.

29. An apparatus according to claim 27, in which the machine is a card.

* * * * *